US005912609A

United States Patent [19]

Usui et al.

[11] Patent Number: 5,912,609

[45] Date of Patent: Jun. 15, 1999

[54] POT-CORE COMPONENTS FOR PLANAR MOUNTING

[75] Inventors: Hideaki Usui; Kouki Sato, both of Akita-ken, Japan

[73] Assignee: TDK Corporation, Tokyo, Japan

[21] Appl. No.: 08/884,940

[22] Filed: Jun. 30, 1997

[30] Foreign Application Priority Data

Jul. 1, 1996 [JP] Japan ..... 8-188045

[51] Int. Cl.[6] ..... H01F 27/02; H01F 27/28

[52] U.S. Cl. ..... 336/83; 336/225; 336/220; 336/221; 336/192

[58] Field of Search ..... 336/83, 225, 192, 336/220, 221, 180, 183

[56] References Cited

U.S. PATENT DOCUMENTS 3,169,234 2/1965 Renskers ..... 336/192

4,204,087 5/1980 Liu et al. ..... 336/223

FOREIGN PATENT DOCUMENTS 59-46021 3/1984 Japan ..... 386/83

4-364009 12/1992 Japan ..... 336/192

5-66922 9/1993 Japan ..... 336/83

*Primary Examiner*—Lincoln Donovan

*Assistant Examiner*—Anh Mai

*Attorney, Agent, or Firm*—Panitch Schwarze Jacobs & Nadel, P.C.

[57] ABSTRACT

A coil component comprises a pot core having through holes formed in the bottom, a coil so shaped as to fit in the pot core, and a cover core joined to the rim of the pot core. The coil has terminals inserted in the through holes to such an extent that their lower ends do not protrude beyond the bottom. The bottom has membrane external electrodes formed on its outersurface and connected with the terminals.

7 Claims, 11 Drawing Sheets

POT-CORE COMPONENTS FOR PLANAR MOUNTING

BACKGROUND OF THE INVENTION

This invention relates to coil components mainly intended for the control of common-mode noise in power supply input circuits of desktop electronic apparatus such as notebook type computers, word processors, and game machines, especially personal computers.

There are two prior art types of coil components. One type has a structure such that a bobbin that carries windings is fitted in a pot core half, coil terminals are pulled out of through holes or through grooves, and another pot core half is fitted over them (Japanese Utility Model Application Kokai No. 5-66922). The other type has grooves formed in the rim of a pot core, through which terminals are pulled out and then a plate cover core is joined to the pot core (Japanese Utility Model Application Kokai No. 59-46021). The former type of Utility Model Application Kokai No. 5-66922, as illustrated in FIGS. 17 and 18, is a magnetic core made up of two core halves 5 joined top to top, each of which being a pot core half consisting of an inner post 1, a wall 2, and a bottom 3 which has through holes 4. A bobbin 7 including windings 6 is fitted in the annular space defined in the pot core halves 5, and pin terminals 8, 8 of the bobbin windings are drawn out via the through holes 4 or, alternatively, end portions of the bobbin windings are bent and pulled out of the core by way of through grooves (not shown). According to the latter type of Utility Model Application Kokai No. 59-46021, as shown in FIG. 19, grooves are formed in the rim of the wall 2 of a pot core 5, and winding terminals 8, 8 are drawn out through the grooves between the pot wall and a cover core 11. In both types the terminals of wirings protrude out of the core through the holes or grooves.

With the tendency toward smaller electronic equipment, planar mounting of their components is acquiring growing importance. The technology is required for a broad range of applications, from micro-current lines to power-supply circuits in which large current flows, or even to battery peripherals. However, planar mounting of large-current components has been hampered by the lack of an adequate technique for thick conductor fabrication. Even today, components of lead-mount type are predominant and, because their externally protruding terminals keep them from being directly mounted on and soldered to circuit boards, they place obstacles in the way of simplification of component mounting process and miniaturization of equipment.

SUMMARY OF THE INVENTION

In order to solve the problems of the prior art, the present invention provides a coil component comprising a pot core having a bottom and through holes formed in the bottom, a coil retained in the pot core, and a cover core joined to the rim of the pot core, said coil having shape-retaining terminals inserted in the through holes to such an extent that their lower ends do not protrude beyond the bottom, the bottom having membrane external electrodes formed on its outer surface and connected with the terminals.

The construction described above permits the use of low-resistance, large-diameter wires to handle large current, through membrane external electrodes and coil terminals combined by a conductor joining technique using solder or the like.

DESCRIPTION OF PREFERRED EMBODIMENTS

In embodying the invention it is desired to set the diameter of the through holes in the pot core larger than the diameter of the coil wires. This enables ample solder to fill up the spaces between the coil ends held in the holes and the remainder of the holes open to outer surface of the bottom, thus providing low-resistance conductive paths capable of coping with large current. Moreover, the fact that the through holes are moderately larger in diameter than the coil wire increases the tolerance on the terminal-to-terminal distance of the coil and makes the coil easier to form.

According to the invention, the pot core desirably has one or more gaps formed between the wall surrounding the coil and a cover core as air passages. The air passages prevent airtight closure of the coil-holding space inside the pot core, thereby avoiding the deterioration of the core-cover adhesion which would otherwise result from the expansion of air that forces the two parts apart. They preclude the phenomenon of dielectric breakdown due to condensation of moisture that gains entrance from the outside. Further, they provide protection against short-circuiting with molten solder of the joint that the air enclosed in the coil-holding space might draw into the space by way of the through holes as the air expands with heat and shrinks at the time of mounting of the component on a board.

To help secure the electric connection and reduce the resistance, each through hole of the pot core desirably has a membrane internal electrode formed along its inside wall and integrally connected with an external electrode.

The coil comprises a plurality of wire layers wound one over another with respect to the inner post (by layer winding). The construction decreases both height and thickness of the resulting core, making it suitable for planar mounting.

Figure 1:
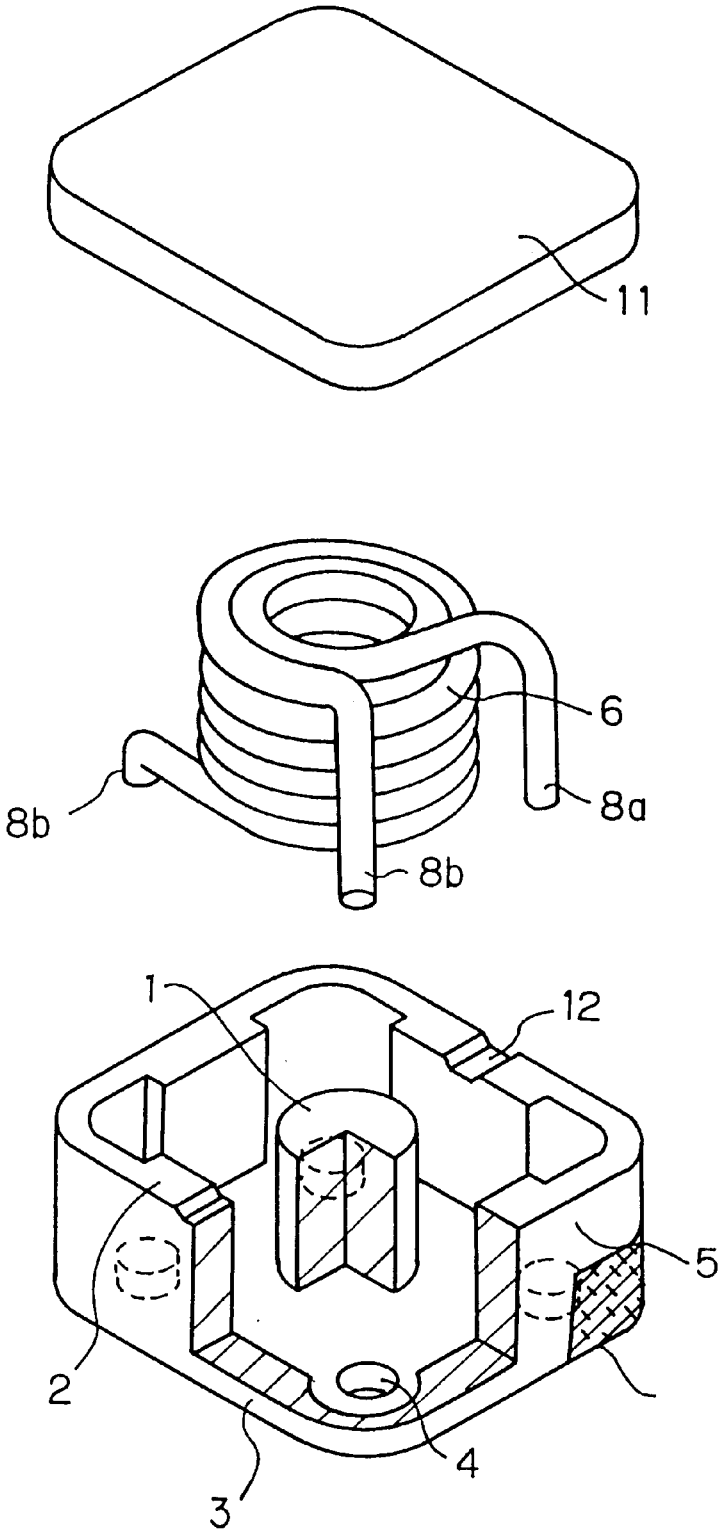
FIG. 1 is an exploded view of a coil component using a pot core of the invention.
Figure 2:
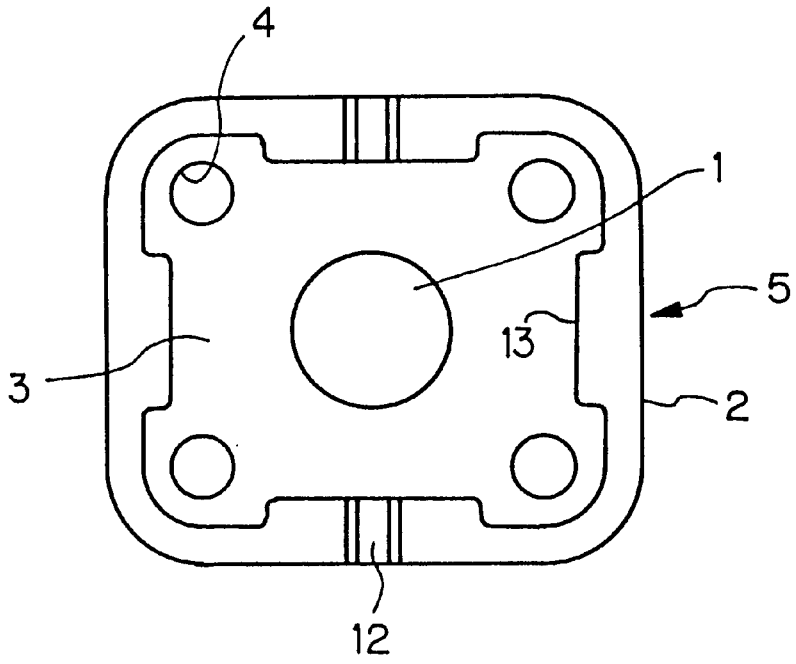
FIG. 2 is a plan view of a pot core according to the invention.
Figure 3:
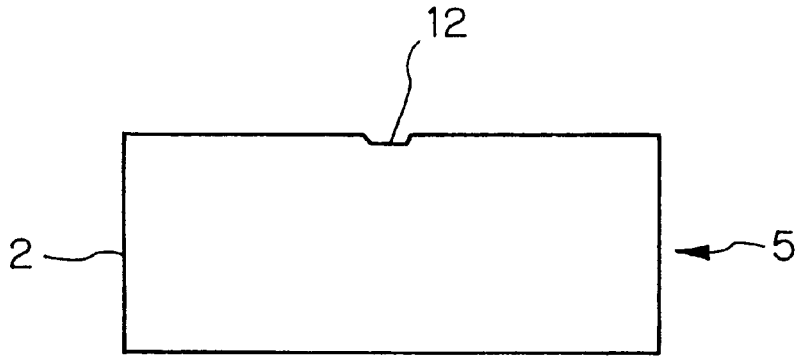
FIG. 3 is a front view of a pot core according to the invention.

FIG. 1 is an exploded view of a coil-holding component using a pot core according to the present invention, and FIGS. 2 and 3 are plan and front views, respectively, of the pot core 5. Parts like those of conventional coil components are designated by like reference numerals.

Figure 20:
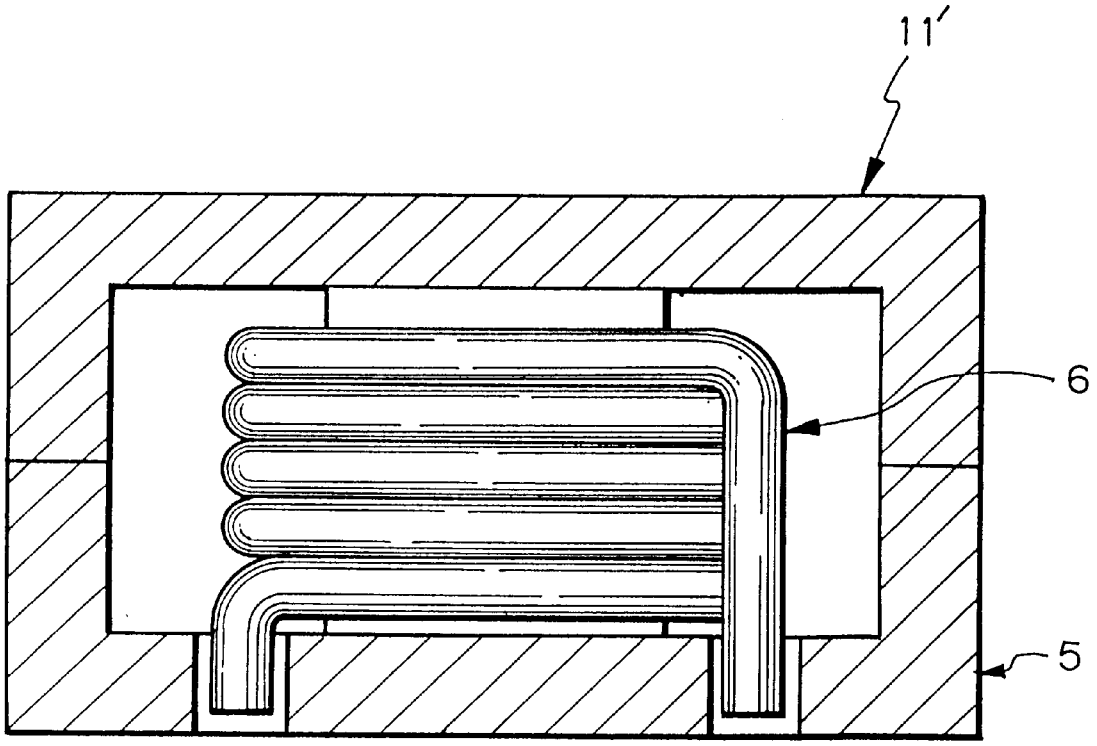
FIG. 20 is a cross sectional view of a coil formed according the present invention with a modified cover core.

As illustrated in FIG. 1, the coil component of the invention comprises a pot core 5 of soft magnetic material, a coil 6 of a given shape housed inside the pot core, and a plate cover core 11 that covers the pot core 5. Alternatively, the cover core may be of any shape such as pot-like shape as shown in FIG. 20 although plate shape is preferred.

As FIGS. 1 to 3 show, the pot core 5 is made up of a nearly completely closed bottom 3, a columnar inner post 1 formed in the center, and a wall 2 that provides an annular space to accommodate a coil. The core is oriented as desired, e.g., by proper marking (not shown) at the time of molding or after sintering. Its bottom 3 has four round through holes 4 formed in four corners, at points corresponding to the positions of terminals 8 of the coil 6. The through holes 4 are designed to have a bore sufficiently larger than the diameter of the terminals of the coil 6 to increase the allowance for registration and decrease the resistance of the joint formed between the coil and external electrode membrane by solder injection.

The portions of the wall 2 surrounding the four through holes 4 are made thin enough to provide guide means for the guide terminals 8. The remainder of the wall has a thick wall structure 13 to reduce the magnetic reluctance when it is joined to the plate cover core 11.

At least one recess 12 is formed (two recesses are shown) in the rim portion of the pot core 5 where a gap is formed when the core is joined with the plate cover core 11. The resulting gap is intended to avoid the airtight closure of the core, for the action to be explained later.

Figure 4:
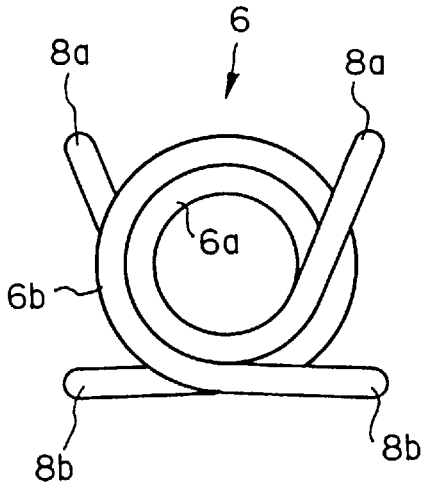
FIG. 4 is a plan view of a pot core according to the invention.
Figure 5:
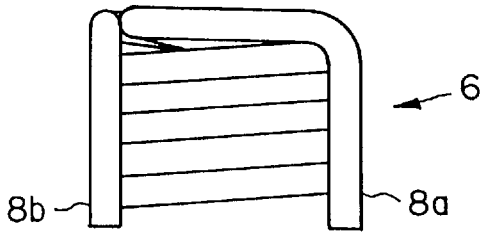
FIG. 5 is a side view of a coil according to the invention.
Figure 6:
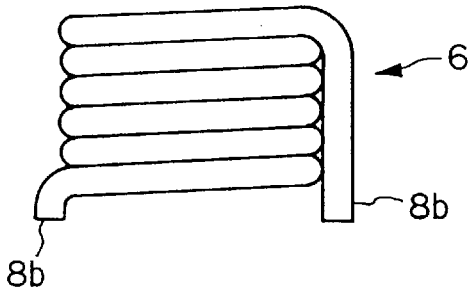
FIG. 6 is a plan view of a coil according to the invention.
Figure 15:
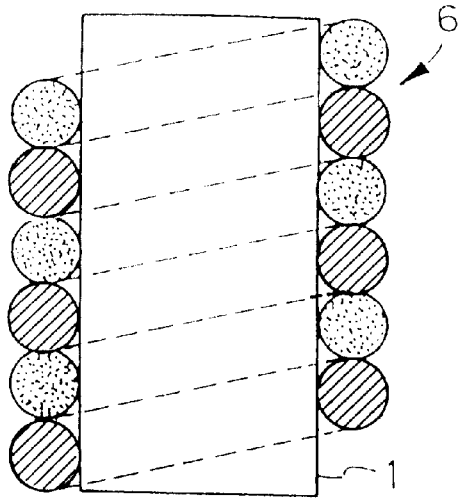
FIG. 15 is a schematic view of a coil formed by bifilar winding.
Figure 16:
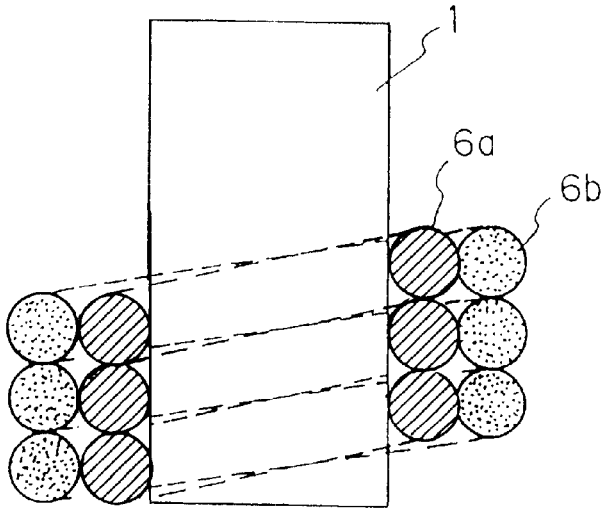
FIG. 16 is a schematic view of a coil formed by layer winding.
Figure 17:
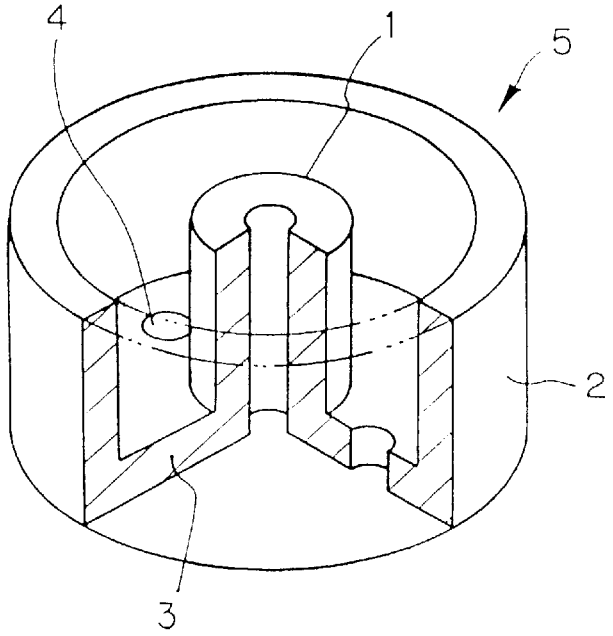
FIG. 17 PRIOR ART
FIG. 17 is a partly broken perspective view of a pot core in a conventional coil component.
Figure 18:
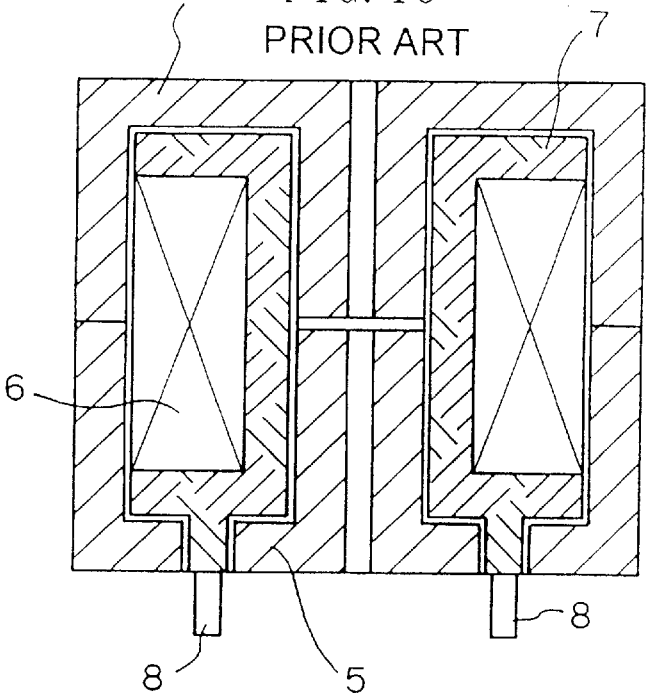
FIG. 18 PRIOR ART
FIG. 18 is a sectional view of a conventional coil component using the pot core shown in FIG. 17.
Figure 19:
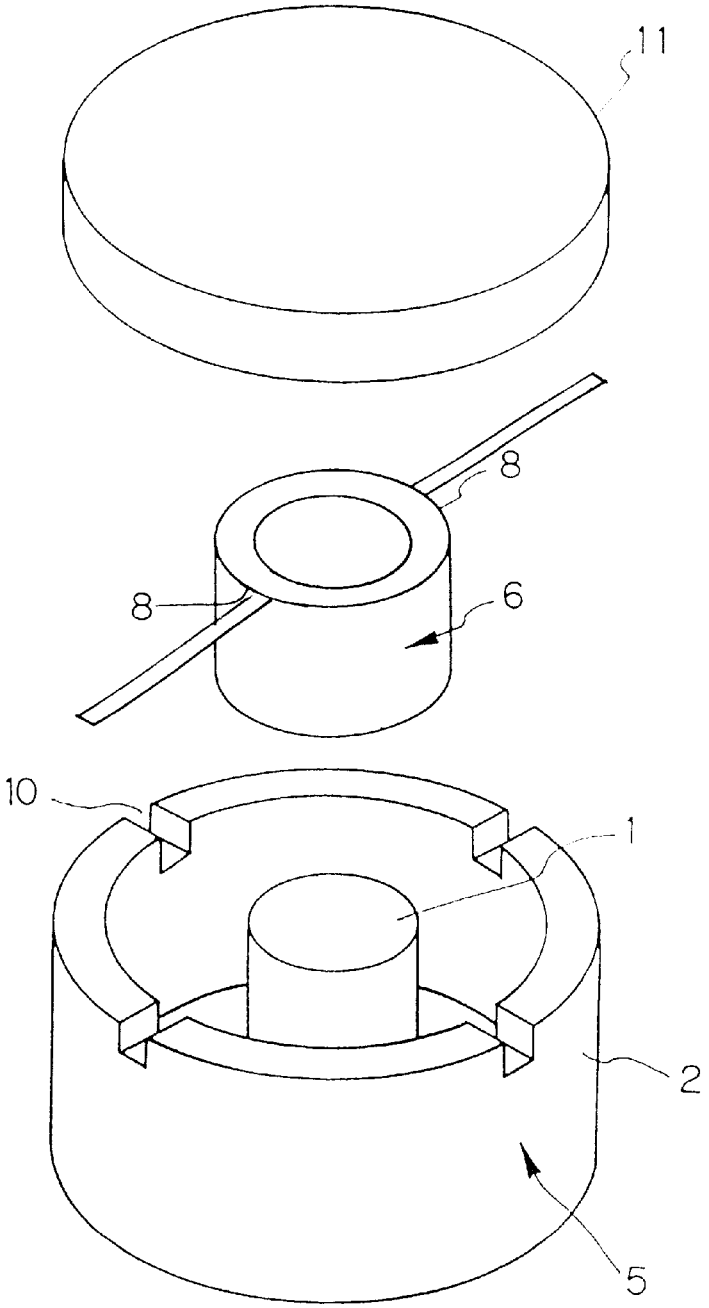
FIG. 19 PRIOR ART
FIG. 19 is an exploded view of another conventional coil component.

The construction of the coil 6 is illustrated in FIGS. 4 to 6. FIG. 4 is a plan view, FIG. 5 is a side view, and FIG. 6 is a front view of the coil. The coil 6 has a so-called layer-wound structure comprising an inner coil layer 6*a* and an outer coil layer 6*b* with respect to the axis of winding. The layer-wound structure limits the height of the coil, making it closer to a plate type than a bifilar-wound structure (FIG. 15) and smaller in size (FIG. 16). The coil 6 is self-supporting owing to the shape-retaining property of the thick wire used such as copper protected by an insulating conating. It also has terminals 8*a*, 8*a* of one winding and terminals 8*b*, 8*b* of the other winding that fit in the through holes 4, at terminal-to-terminal distances substantially equal to the distances between adjacent through holes 4. The diameter of the inner coil layer 6*a* is slightly larger than the outside diameter of the inner post 1. As can be seen from the drawings, the coil 6 is apparently asymmetric in structure and has a directional property.

The necessary diameter required for the coil being self-supporting or shape-retaining is about 0.1 mm or more. This size will also reduce the electric resistance to lower the heat generation. Silver wire may also be used.

The terminals 8 are designed to have lengths such that, when the coil 6 is oriented in the same direction as the pot core 5 and is fitted onto the inner post 1 and housed in position inside the core, with the terminals 8 forced into the through holes 4, the lower ends of the terminals do not protrude downwardly beyond the bottom. Also, in order that the terminals can loosely fit in the through holes 4, they are positioned so that the distance between two adjacent terminals is substantially the same as the distance between the axes of two adjacent through holes.

Use of the shape-retaining coil is preferred from standpoint of designing smaller coils. However, use of a bobbin is not excluded to assist the shape- retaining property of the coil except that the shape and their relative positions of the terminals are retained. Alternatively, an adhesive may be applied to the outer surface of the coiled wire so that the turns of the coil are jointed together to enhance the shape-retaining property.

Figure 7:
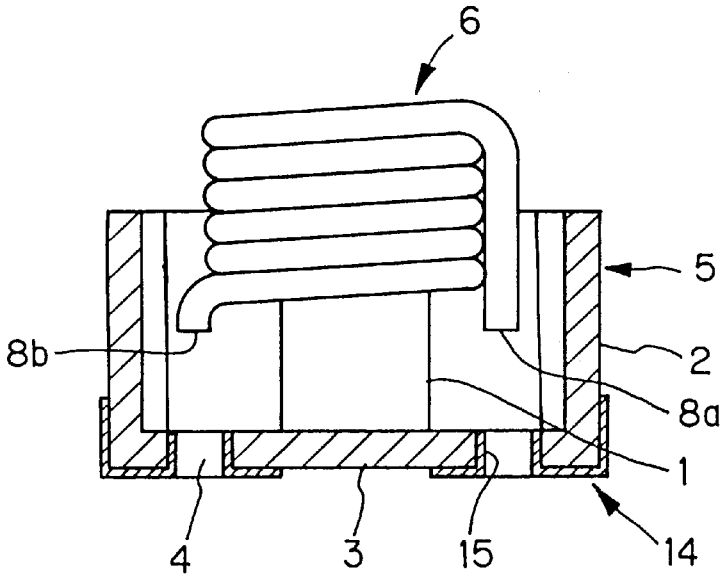
FIG. 7 is a sectional view of a pot core and a coil according to the invention in an early stage of assembling.
Figure 8:
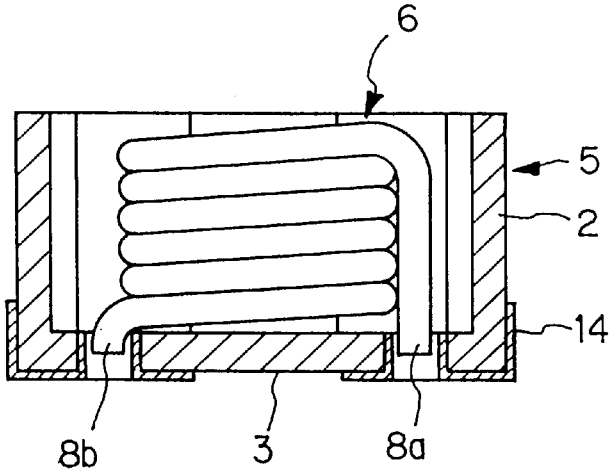
FIG. 8 is a sectional view of the pot core and coil shown in FIG. 7 in the ensuing stage where they are assembled.

As shown in FIGS. 1, 7, and 8, membrane external electrodes 14 are formed around the through holes 4. Preferably, each through hole 4 is lined with a membrane electrode 15 formed integrally with the corresponding external electrode 14. Joining each terminal 8 and the associated external electrode 14 with solder in the manner to be described later will provide an electric connection of low resistivity that can withstand the passage of a large current.

FIGS. 7 and 8 illustrate how the pot core 5 and coil 6 are assembled. As FIG. 7 shows, the coil 6 and pot core 5 are oriented together and mated, with the inner coil layer 6*a* fitted onto the inner post 1 of the pot core 5. Then, as in FIG. 8, the lower ends of the terminals 8 of the coil remain inside the holes of the bottom 3. The depth of the coil-holding space of the pot core is greater than the height of the coil excepting its terminal portions that are received by the through holes. Next, before or after the step to be described below, the top of the pot is closed with the cover core 11 and joined together to conclude the assembly of the coil component.

Figure 9:
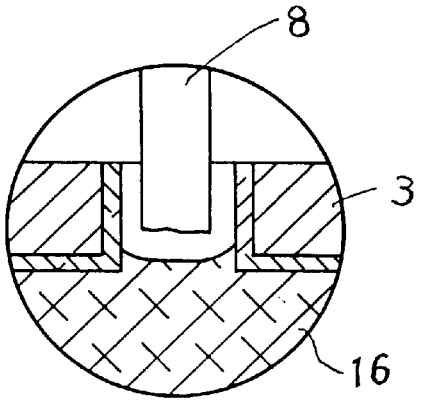
FIG. 9 shows an early stage of joining a terminal of a coil according to the invention to an external electrode with solder.
Figure 10:
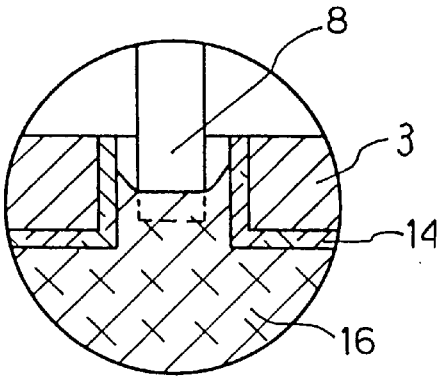
FIG. 10 shows an intermediate stage of joining a coil terminal to an external electrode with solder.
Figure 11:
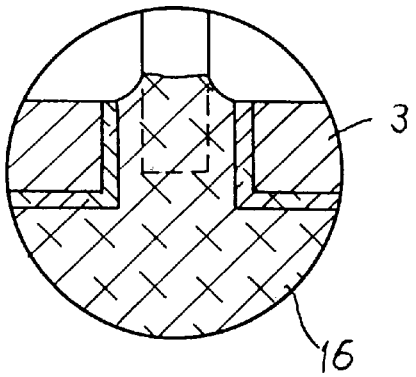
FIG. 11 shows the final stage of joining a coil terminal to an external electrode with solder.

FIGS. 9 to 11 show the manner in which each terminal 8 of the coil 6 and an external electrode 14 are connected. The bottom 3 of the pot core 5 holding the coil 6 is dipped into a bath of molten solder for a predetermined period of time. The molten solder then ascends from the dipped bottom into the through holes 4, in the order shown in FIGS. 9, 10, and 11. For this reason it is advisable that an electrode 15 be formed beforehand along the wall of each through hole. The solder fills up the space between the through hole 4 and the terminal 8, while its heat breaks the insulation coating of the terminal 8, until electric connection is established between the terminal and the external electrode 14.

Figure 13:
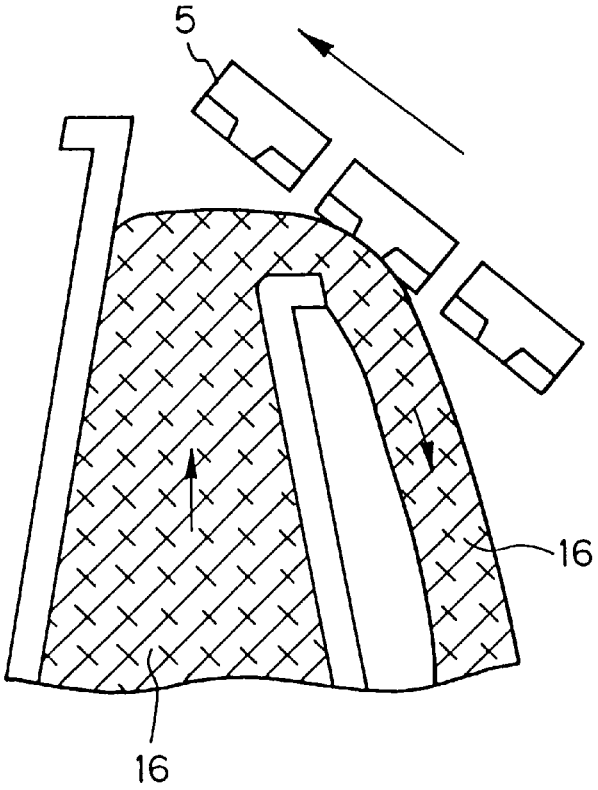
FIG. 13 illustrates a procedure of joining coil terminals and external electrodes by flow soldering in accordance with the invention.
Figure 14:
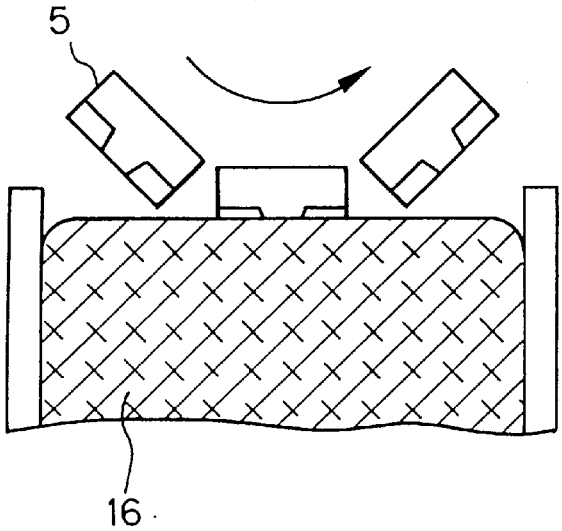
FIG. 14 illustrates another procedure of joining coil terminals and external electrodes with solder in accordance with the invention.

In FIG. 13 is illustrated a solder finish that makes the bottom condition suited for planar mounting. The locus of dipping of pot cores 5 is made generally reverse to the direction in which an ascending jet of solder 16 overflows. The arrangement permits excess solder to be dropped off from each pot. A similar effect is achieved by controlling the direction in which pot cores 5 travel as in FIG. 14.

Figure 12:
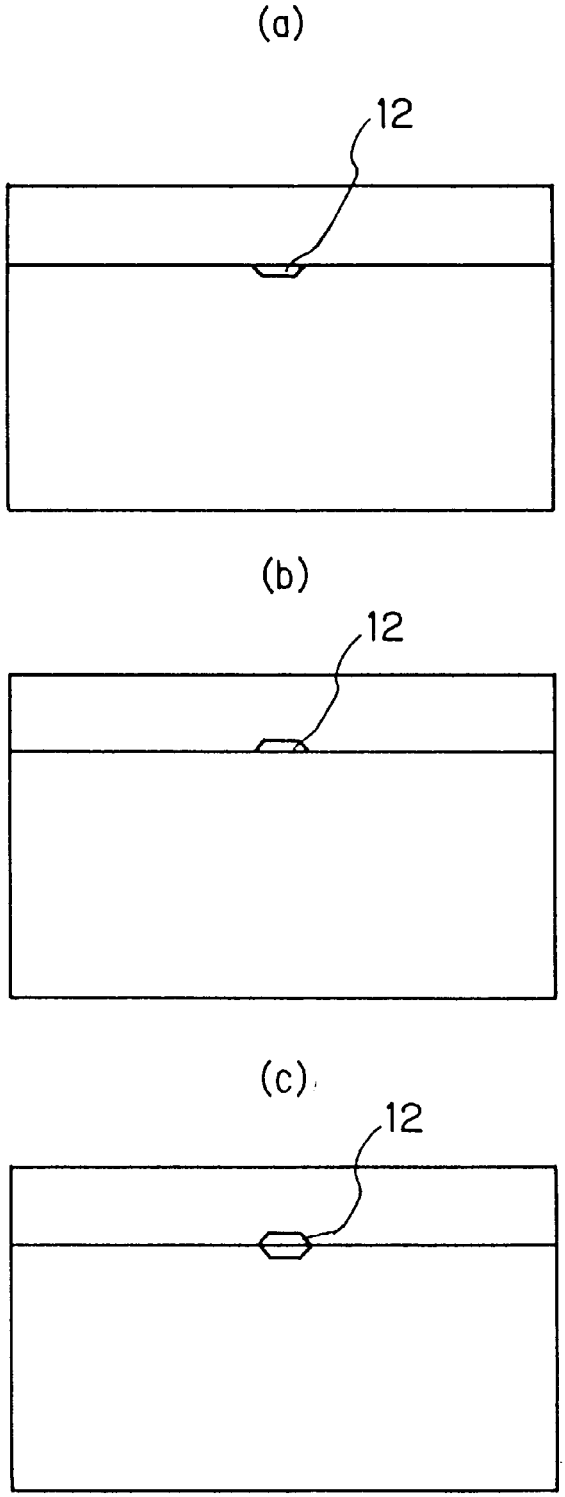
FIG. 12 shows three examples (a), (b), and (c) of a gap between a pot core and cover core.

FIG. 12 shows varied conditions of joint between a pot core 5 holding a coil and a plate cover core 11. A recess 12 is formed on the side of the pot core 5 at (a) or on the side of the cover core 11 at (b), or two recesses 12 are formed on both at (c). They are equivalent in effect. A plurality of such gaps provided along the joint, of a size not large enough to substantially ruin the magnetic shield effect of the joint, brings about the effects b, c, and d to be listed below.

The beneficial effects that are obtained from the composition of the invention thus far described are as follows:

a. Since the bore of the through holes is moderately larger than the diameter of the wire, the tolerance on the terminal-to-terminal distance of the coil is great enough to facilitate coil forming.

b. The gap or gaps formed in the joint between the pot core and the cover core permit air to pass through so that, when the two are joined, the coil-holding space is not airtightly closed and there is no possibility of air expanding to force the jointed surfaces apart and lessen their adherence.

c. The gap or gaps in the joint between the pot core and the cover core permit air to pass through. Without these gaps, the coil-holding space would be airtightly closed when the two are joined, and expanding air would come out of the joint, forming a minute opening or openings for air passage and allowing external moisture to come in. The moisture once trapped inside cannot escape completely and can condense and cause dielectric breakdown. The gap or gaps prevent these phenomena.

d. The gap or gaps in the joint between the pot core and the cover core permit air to pass through. Without these gaps, expansion and shrinkage of the air in the coil-holding space at the time of mounting the component on a printed circuit board would draw the solder used in joining into the space by way of the through holes, with the danger of short-circuiting. The gap or gaps prevent this possibility.

e. Except for the portions around the through holes, the wall of the pot core is thick enough to secure an adequate area for joining with the cover core and increase the pseudo-cross sectional area of the core, with a consequent improvement in magnetic coupling.

f. The gap or gaps provided in the joint between the pot core and plate core cover effectively release the heat that the coil generates, thus controlling the temperature rise of the component.

g. The layer-wound structure composed of two coil layers, one inside and the other over it with respect to the axis of winding, can be made to have a large finished coil outside diameter but a minimized overall coil length, compared with the bifilar-wound structure that is often used in the common mode, under the same conditions (number of turns, diameter of winding, and wire size). Setting the coil length in the vertical direction facilitates the component design, in respect of the height limitation, miniaturization in size, and high reliability, as a component for planar mounting.

What is claimed is:

1. A coil component comprising a pot core having a bottom in which four through holes are formed, a coil retained in the pot core, and a cover core joined to a rim of the pot core, said coil being a shape-retaining coil comprising a pair of windings having four terminals located in the through holes so that the lower ends thereof do not protrude beyond a bottom outer surface of said pot core, a wall of each of said through holes being lined with an internal membrane electrode extending from and integrally formed with external membrane electrodes formed on the bottom outer surface said terminals being located in the through holes with a gap between said terminals and said walls of said through holes, said terminals being connected with the internal and external membrane electrodes by solder filled in the gap between said terminals and said internal electrode membrane.

2. The coil component of claim 1, wherein the through holes of the pot core have a diameter larger than the diameter of the wire forming the coil.

3. The coil component of claim 1, wherein said pot core has a wall surrounding the coil, with at least one gap formed in the joint between the wall and the plate core cover.

4. The coil component of claim 1, wherein said wall of the pot core is thinner around the through holes than in a remainder of said wall of the pot core.

5. The coil component of claim 1, wherein said pair of windings are integrally formed as inner and outer windings, with a plurality of wire layers wound one over another, about an inner post of the core.

6. The coil component of claim 5, wherein said windings having an outer surface coated with an adhesive to join turns of said windings to adjacent turns of said windings.

7. The coil component of claim 1, wherein said cover core is a plate.

* * * * *